US006769250B2

(12) United States Patent
Fuss et al.

(10) Patent No.: US 6,769,250 B2
(45) Date of Patent: Aug. 3, 2004

(54) FLUIDIC SYSTEM WITH A SAFETY FUNCTION

(75) Inventors: Martin Fuss, Aichwald (DE); Josef Sauer, Wernau (DE); Udo Walden, Aichwald (DE)

(73) Assignee: Festo AG & Co., Esslingen (DE)

( * ) Notice: Subject to any disclaimer, the term of this patent is extended or adjusted under 35 U.S.C. 154(b) by 21 days.

(21) Appl. No.: 10/182,489

(22) PCT Filed: Jan. 20, 2001

(86) PCT No.: PCT/EP01/00624

§ 371 (c)(1),
(2), (4) Date: Jul. 30, 2002

(87) PCT Pub. No.: WO01/59307

PCT Pub. Date: Aug. 16, 2001

(65) Prior Publication Data

US 2003/0010198 A1 Jan. 16, 2003

(30) Foreign Application Priority Data

Feb. 12, 2000 (DE) ..... 100 06 367

(51) Int. Cl.[7] ..... F15B 20/00
(52) U.S. Cl. ..... 60/403; 60/406
(58) Field of Search ..... 91/447, 392; 60/403, 60/406, 392

(56) References Cited

U.S. PATENT DOCUMENTS 3,724,330 A * 4/1973 Mason ..... 91/363 A
4,191,913 A * 3/1980 Arnold et al. ..... 318/563
4,334,216 A * 6/1982 Lacroix ..... 91/363 A
4,967,124 A * 10/1990 Hirai ..... 318/564
5,269,098 A * 12/1993 Redman ..... 49/360
5,422,553 A * 6/1995 MacLennan et al. ..... 318/565

FOREIGN PATENT DOCUMENTS

| | | |
|---|---|---|
| EP | 0 603 395 A1 | 6/1994 |
| EP | 1 061 269 A2 | 12/2000 |
| GB | 2 318 426 A | 4/1998 |
| JP | 01283402 | 11/1989 |
| JP | 07019207 | 1/1995 |

* cited by examiner

*Primary Examiner*—Edward K. Look
*Assistant Examiner*—Igor Kershteyn
(74) *Attorney, Agent, or Firm*—Hoffmann & Baron, LLP

(57) ABSTRACT

A fluid control system for security relevant control and a fluid control actuator, a local control means for a fluid control system, a software module for a local control means of a fluid control system and a method for the operation of a fluid control system. The fluid control actuator (10) is controlled by control instrumentality means (30) of a local control means (50). A sensor (16, 17, 27, 41 and 42) transfers information concerning operational states of the fluid control system to the local control means (50). For this purpose there is a provision such that the local control means (50) determines from such information whether there is a security relevant situation and if necessary performs a predetermined function. The security relevant functions are integrated in the fluid control system so that same is able to be employed as prefabricated unit.

24 Claims, 3 Drawing Sheets

| ST | 31 | 32 | 33 | 23 | 21 | 20 | 27 | 42 | 41 | 17 | 16 |
|---|---|---|---|---|---|---|---|---|---|---|---|
| 200 | 0 | 0 | 1 | 1 | 1 | 1 | 1 | 0 | 1 | 1 | 0 |
| 201 | 0 | 0 | 1 | 1→0 | 1→0 | 1→0 | 1→0 | x | x | 1 | 0 |
| 202 | 0 | 0→1 | 1→0 | 0 | 0 | 0 | 0 | 0→1 | 1→0 | 1 | 0 |
| 203 | 0→1 | 1→0 | 0 | 0 | 0 | 0 | 0 | 1 | 0 | 1 | 0 |
| 204 | 1 | 0 | 0 | 0→1 | 0→1 | 0→1 | 0→1 | 1 | 0→1 | 1 | 0 |
| 205 | 1→0 | 0 | 0→1 | 1 | 1 | 1 | 1 | 1→0 | 1 | 1 | 0 |
| 206 | 0 | 0→1 | 1→0 | 1 | 1 | 1 | 1 | 0→1 | 1→0 | 1→0 | 0→1 |

Fig. 2

| ST | 31 | 32 | 33 | 23 | 21 | 20 | 27 | 42 | 41 | 17 | 16 |
|---|---|---|---|---|---|---|---|---|---|---|---|
| 300 | 0 | 1 | 0 | 1 | 1 | 1 | 1 | 1 | 0 | 0 | 1 |
| 301 | 0 | 1 | 0 | 1→0 | 1→0 | 1→0 | 1→0 | x | x | 0 | 1 |
| 302 | 0 | 1→0 | 0→1 | 0 | 0 | 0 | 0 | 1→0 | 0→1 | 0 | 1 |
| 303 | 0→1 | 0 | 1→0 | 0 | 0 | 0 | 0 | 0 | 1 | 0 | 1 |
| 304 | 1 | 0 | 0 | 0→1 | 0→1 | 0→1 | 0→1 | 0→1 | 1 | 0 | 1 |
| 305 | 1→0 | 0→1 | 0 | 1 | 1 | 1 | 1 | 0 | 1→0 | 0 | 1 |
| 306 | 0 | 1→0 | 0→1 | 1 | 1 | 1 | 1 | 1→0 | 0→1 | 0→1 | 1→0 |

Fig. 3

FLUIDIC SYSTEM WITH A SAFETY FUNCTION

BACKGROUND OF THE INVENTION

The invention relates to a fluid control system for the security orientated control of at least one fluid power actuator or actor, comprising at least one local control means for the control of the fluid power actuator by way of control instrumentality means of the fluid control system, at least one sensor being provided for the transfer of at least one information item in relation to at least one operational state of the fluid power system to the local control means.

Furthermore, the invention relates to a fluid control actuator, a local control means for a fluid control system, a software module for a local control means of a fluid system and to a method for the operation of a fluid control system.

One system, of the type to which the invention relates, and termed a "fluid control" system may for example be operated as a pneumatic system with the aid of compressed air or as a hydraulic system with the aid of hydraulic oil as a pressure medium or "fluid". In this case an electrical control means controls, by way of control instrumentality means, as for example valves, the flow of the pressure medium for the operation of the fluid control actuator or actuators. Such an actuator is for example a fluid power cylinder. The respective operational state of the fluid control system is in this case monitored with the aid of a sensor. It may for example be attached to the fluid control actuator of a position sensing system, which provides the control means with information as regards the respective position of the actuator so that same may, on the basis of the information, influence the position of the actuator by suitably acting on it with the pressure medium.

In the case of known fluid control a basic assumption is that by suitable design of the fluid control system it is possible to prevent a security risk occurring within the respective fluid control system. Protection against accidental changes in the condition of, or position in, the fluid control system, as for instance a sudden movement of a piston in a fluid power cylinder owing to a defect of a valve controlling the fluid power cylinder, is however not provided for.

SUMMARY OF THE INVENTION

One object of the invention is to provide security functions for fluid control systems.

This object is to be attained by a fluid control system for the security relevant control of at least one fluid control actuator, having at least one local control means for the control of the fluid control actuator by way of control instrumentality means of the fluid control system, there being at least one sensor for the provision of at least one item of information as regards at least one operational state of the fluid control system to the local control means, characterized in that the local control means is so designed that it can evaluate at least one item of information for detecting at least one security relevant state and that, given at least one security relevant state, it implements at least one predetermined consequential action.

The object is furthermore to be attained by a fluid control actuator in accordance with the technical teaching of claim 16, by a control means in accordance with the technical teaching of claim 17, by a software module in accordance with the technical teaching of claim 18 and by a method in accordance with the technical teaching of claim 19.

In this respect the invention is based on the notion of integrating security relevant functions in the fluid control system for the control of the actuator, such functions fulfilling simple and also advanced requirement classes, for instance in accordance with the European standard EN 941-1. The fluid control actuator can for instance be a valve arrangement, a pneumatic drive or a servicing unit. The control instrumentality means may for example comprise a valve arrangement, and be operated by an electronic control module as a local control means. If within the control instrumentality means, the local control means or the controlled fluid control actuator a security relevant, improper function occurs, the local control means will recognize this problem and will initiate consequential action to deal with it.

The local control means ensures that a security relevant state does not pass unrecognized. The monitoring of the security function can then be attuned to the respective fluid control system in a optimum fashion and more particularly to the actuator, which is to be controlled. Sensor instrumentalities, which are in any case present, may then be employed for the security functions as well. It is however also possible that with the aid of some additional sensors even higher security criteria may be attained. Moreover, the fluid control system may be utilized as a complete, compact and prefabricated unit, already having integrated security functions, which for instance may cooperate with a higher order control means. They then do not have to be matched to the locally required security functions in an elaborate manner. The local control means may also transmit and receive messages specially adapted for;the transfer of security relevant information and for the issue of security relevant commands.

The fluid control system in accordance with the invention, which is security orientated, may also be designed as part of a fluid control actuator or actor. Thus for instance the fluid control system may be integrated in a locally controlled valve arrangement, which may be a single valve or a valve group, that is to say a so-called valve island. Furthermore, the security orientated system in accordance with the invention may be a component of a fluid drive, as for example of a pneumatic gripper, a pneumatic cylinder or a pneumatic linear drive. A switch-on valve, a servicing device, as for instance an oiler or a "pneumatic emergency off means" may be controlled by an external or integrated fluid control system in a security orientated manner. Thus in accordance with the invention shut off valves integrated in a pneumatic cylinder may be controlled.

As an example the control means may in accordance with the invention check an information item, as supplied by a sensor for monitoring the movement speed of an actuator, as to whether a predetermined speed of movement of the actuator is being exceeded. In such a case the sensor may even be employed for a plurality of functions, on the one hand for the control of the speed of movement as regards a predetermined value and on the other hand for checking to see whether the actuator has exceeded a security relevant speed of movement.

Further advantageous developments of the invention are defined in the dependent claims.

Once the local control means has detected the existence of a security relevant state, it may for instance cause the fluid control actuator to assume a secure state of operation as a consequential action, such state being for example a so-called "emergency stop" function, in the case of which the actuator is halted.

Moreover, the local control means may, for example by way of an LED or a loudspeaker, signalize the presence of the security relevant state and thus facilitate the location of a fault by the operator. Furthermore the local control means may transmit a message concerning the presence of the security relevant state to a higher order control means, if the local control means acts for example as a slave on a bus and is controlled and monitored by the higher order control means functioning as a master. In this case it is also possible for the higher order control means to give an instruction to the local control means for bringing the fluid control actuator into a safe operational state, that is to say for instance the above mentioned "emergency halt" function.

In a particularly preferred form of the invention the fluid control system comprises fluid power and/or electrically operated switching off means, which are able to be controlled by the local control means for switching off the effective function of the control instrumentality means as regards the fluid control actuator. The switching off means are for instance check valves placed between the control instrumentality means and the actuator. This means that it is possible for the control instrumentality means to be switched off and therefore decoupled from the actuator, when a fault occurs in the control instrumentality means. Thus for example a valve may leak so that the actuator will assume an irregular, undesired position. The local control means can find such a fault for example using control checking means cooperating with same, as for example pressure sensors, for checking the control instrumentality means.

Moreover, using the switching off means it is possible to cause the local control means firstly to at least partly switch off the effective function of the control instrumentality means by means of the switching off means and then to perform a check of the control instrumentality means. In this case the control instrumentality means may be operated without any undesired influence on the actuator and for example to run through a check cycle. Such a check cycle is for example performed in each case prior to operation of the control instrumentality means so that same are only employed for operation of the actuator, when they function correctly. The control instrumentality means may also be checked cyclically so that any malfunction of the control instrumentality means will be detected, if same as such have been idle for a long period of time.

In accordance with a further possible form of the invention the switching off means are also checked using for example sensors arranged on the switching off means, which detect changes in the state of the switching off means and signalize such information to the local control means. The local control means will then determine whether the signalized changes in state are in accordance with predetermined, expected changes in state or whether a malfunction, which may possibly be security relevant, of the switching off means is involved. The local control means can then signalize this malfunction to, for example, the higher order control means or cause an "emergency halt" function to take place. The control means may also perform the check on the switching off means cyclically or in each case after operation of the control instrumentality means or of the switching off means.

The fluid control system can also be instructed by the higher order control means by way of check instruction to check both the switching off means cyclically or in each case for each received check instruction.

BRIEF DESCRIPTION OF THE DRAWING

The invention will be described in the following with reference to working embodiments as illustrated in the accompanying drawings.

FIG. 2 is a table of the performance of a check on the working example of FIG. 1 with the fluid power cylinder in a first position.

FIG. 3 is a table as in FIG. 2 with a further check run but with the fluid power cylinder in the second state.

DETAILED DESCRIPTION OF THE PREFERRED EMBODIMENTS

Figure 1:
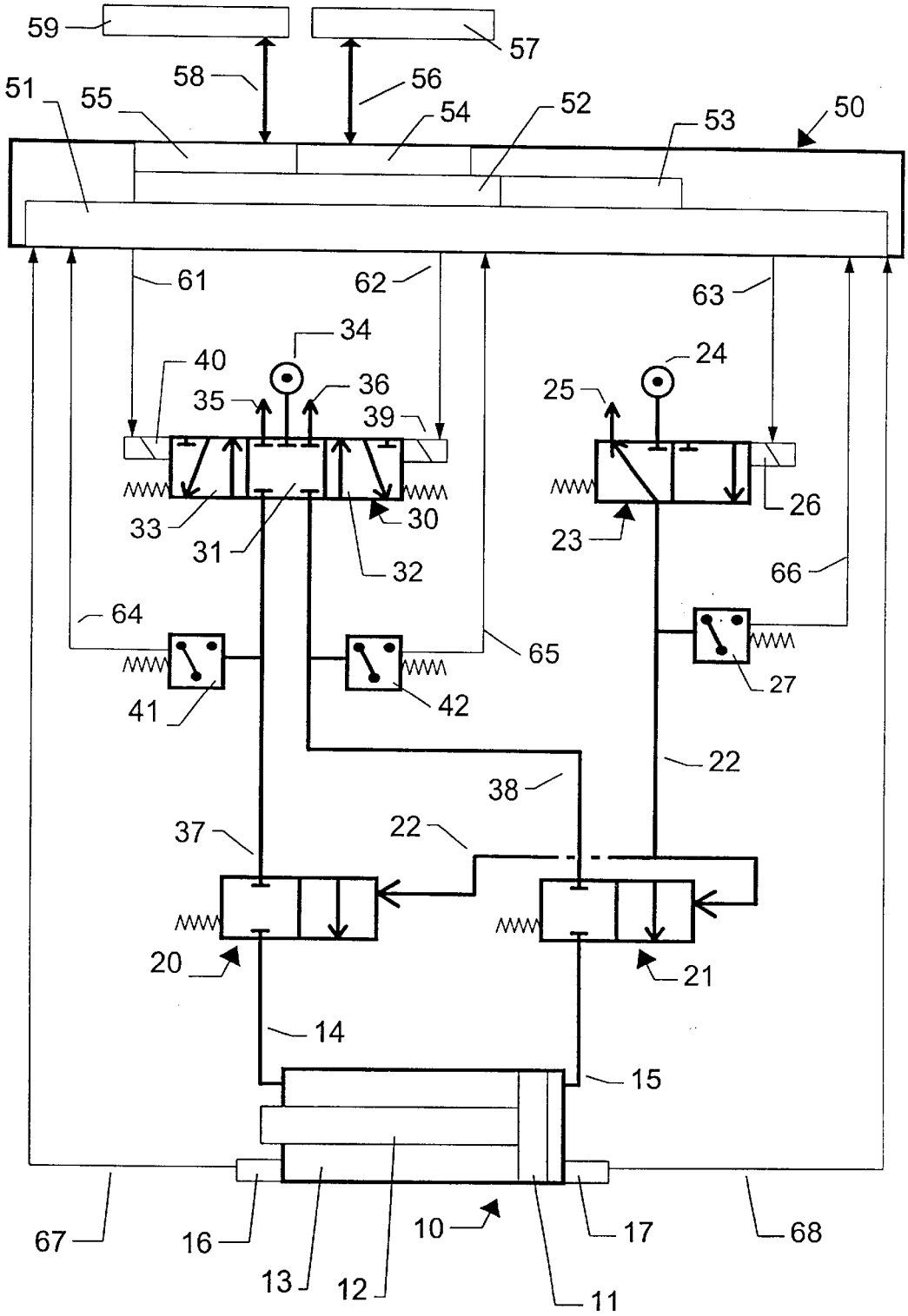
FIG. 1 shows a first embodiment of the invention with a fluid control system, which is controlled by a local control means and acts on a fluid power cylinder.

FIG. 1 shows a fluid power cylinder 10 as a fluid actuator comprising a piston 11 and a piston rod 12 which are able to reciprocate in a working space 13. A fluid as a pressure medium, in the present case compressed air, is able to flow through a cylinder end plate and a line 14 therein at the end of the working space 13 into such space. Accordingly the piston 11 assumes its first (retracted) position the piston rod 12 consequently moves into the working space 13, when at the opposite end facing the face of the piston 11 and at the end plate of the working space 13 by way of a line 15 air displaced by the moving piston is able to escape and the working space 13 is vented. When however by way of the line 15 compressed air flows into the working space 13, the piston 11 moves into the second position the piston rod 12 therefore moves out of the working space 13 providing air can flow out through the line 14. A sensor 16 detects whether the piston 11 has moved out. A sensor 17 detects whether the piston 11 has moved in. Instead of the,fluid power cylinder 10 the actuator may be in the form of a linear drive, a servicing unit for the preparation of compressed air or a pneumatically operated valve as a fluid control actuator.

The line 14 can be switched off by means of a routing valve 21, compressed air then hot being able to flow into the working space 13 and air displaced by the piston 11 is not able to leave the working space 13. The routing valves 20 and 21 accordingly act as switching off means and are so-called 2/2 way valves. A 2/2 way valve has an input and an output, which are separated from each other by the closed position of the respective routing valve or are connected together in an open position of the respective routing valve. The output of the routing valve 20 is connected with the line 14 and the output of the routing valve 21 is connected with the line 15. The routing valves 20 and 21 are able to be acted upon by way of a line 22 by compressed air and then move into the open position. In the switching state of FIG. 1, the switched off position namely, the routing valves 21 and 22 are however not acted upon by compressed air and are held by a spring in the switched off position. At this point it is to be noted that the design of the components illustrated in FIG. 1 is merely symbolic. The routing valves 20 and 121 can for instance also be driven electrically be held by compressed air in the neutral position or be replaced by other valve arrangements with a switching off function.

The line 22 receives compressed air by way of a routing valve 23 or is vented through it. The routing valve 23 is a 3/2 way valve having a power output for the line 22, an input, which is connected with a pressure source 24, and a venting output 25. The routing valve 23 is held in FIG. 1 in the venting position as its neutral position, as indicated by a spring means, in the case of which the line 22 is vented through the venting opening 25. By means of an electrical drive 26, for instance a solenoid drive, it is possible for the routing valve 23 to be moved into a switching position, compressed air then flowing from the pressure source 24 into the line 22 and the routing valves 20 and 21 being moved into the switched on position. The line 22 is furthermore connected with a pressure sensor 27, responsive to the pressure in the line 22. The pressure sensor 27 serves as a switching off check means for checking the routing valves 20, 21 and 22 acting as switching off means. Instead of the pressure sensor 27 as switching off and checking means, sensors could for instance be utilized responsive to the position and arranged on the routing valves 20, 21 and 22.

As control instrumentality means for the control of the fluid power cylinder 10 a routing valve 30 is employed, which in the present case is a 5/3 way valve having three positions, a neutral position 31, a second (piston extended) position 32, a first (piston retracted) position 33 and in all five inputs and outputs, of which one input is connected with a pressure source 34 for supply with compressed air, one respective output 35 and 36 serves for venting and one input/output is connected by way of line 37 with the routing valve 20 and one input/output is connected by way of a line 38 with the routing valve 21.

In the following description of the function of the routing valve 30 the routing valves 20 and 22 will be assumed to be in the on position. The lines 14 and 37 and also the lines 15 and 38 are respectively connected with one another. In the illustrated neutral position 31, which is for example set by springs arranged on the solenoid valve 30, all five inputs and outputs of the routing valve 30 are separated from one another so that no controlling pressure forces or venting forces act on the fluid power cylinder 10 and same will essentially maintain its respective position. When a drive 39, which is arranged on the routing valve 30, is activated, the routing valve 30 will be moved into the second position 32, in which the compressed air flows into the lines 38 and 15 and compressed air may leave by way of the lines 14 and 37 and furthermore the output 35. The piston rod 12 then moves out of the fluid power cylinder 10. If a drive 40, which is also arranged on the routing valve 30, is activated, the routing valve 30 will be moved into the first position 33 so that compressed air will on the one hand flow into the lines 14 and 37 and on the other hand may leave by way of the lines 38 and 15. The piston rod 12 then moves into the fluid power cylinder 10. Instead of the routing valve 30 other valve arrangements are possible. Thus for example instead of the routing valve 30 respectively a 3/3 way valve could arranged on the lines 37 and 38, using which valves pressurization and, respectively, venting and furthermore shut down of the lines 37 and 38 will be possible.

For checking the respective pressure conditions a pressure sensor 41 is provided on the line 37 and a further pressure sensor 42 is provided on the line 38. The pressure sensors 41 and 42 act as control checking means. Furthermore as a check and control means a sensor system could be provided, as for example in the form of end switches for monitoring the function of the routing valve 30, on which it will be arranged.

The routing valves 20, 21 and 23, which are connected together by the line 22 and are supplied from the pressure source, are switching off means for switching off the active function of the routing valve 30 acting as a control means.

The functions of the routing valves 23 and 30 are controlled by way of the respective drives 26 and furthermore 39 and 40 by the a local control means 50. The local control means 50 possesses an input/output module 51, a processor 52, memory means 53 and interface modules 54 and 55 as connection means, which are respectively connected by connections, not illustrated, with each other. The local control means is operated by an operating system and furthermore by software modules, which are stored in the memory means 53 and whose program code sequences are implemented by the processor 52. The memory means 52 comprise for instance RAM modules for data to be temporarily stored and flash memory modules and/or ROM modules for long term data storage.

By way of the interface module 54 connected with a bus 56 the local control means 50 is connected with a higher order control means 57, from which the control means 59 can receive setting commands and to which the control means 50 can signalize information. The bus 56 may be a field bus, as for example an AS-i bus (actor sensor interface), a CAN bus or a Profibus. The higher order control means 57 is in the present example a bus master, whereas the local control means 50 is a bus slave. It is also possible for the local control means 50 to be employed without the higher order control means 57 or for further valves or drives to be connected with the control means 50. The higher order control means 57 may furthermore be omitted completely.

Further still, the local control means 50 can be connected the high order control means 57 by way of digital inputs and outputs.

Furthermore the interface module 55 is connected by way of connection lines 58 with a display and command input module 59. From the display and command input module 59 the control means 50 can receive commands, for instance by way of electrical hand switches or keys. Moreover, the control means 50 may signalize information to the module 59, which the module can display, for example using LEDs. It is furthermore possible for the module 59 to be integrated in the control means 50 or to be dispensed with completely.

The input/output module 521 is connected by way of a connection 61 with the drive 39, by way of a connection 62 with the drive 40 and furthermore by way of a connection 63 with the drive 26. By way of the connections 61, 62 and 63 it is possible for the control means 50 to activate respectively connected drives. Moreover the pressure sensor 41 the pressure sensor 42 by way of a connection 64, the pressure sensor 27 by way of a connection 66 by way of a connection 65, and the pressure sensor 27 by way of a connection 66, signalize the respectively detected pressure values to the input/output module 51 and accordingly to the control means 50 too. Furthermore the sensor 16 sends its readings for the respective fluid power cylinder 10 by way of a connection 67 to the control means 50 and the sensor 17 sends its respective readings related to the fluid power cylinder 10 to the control means 50. The (monitoring) connections 64, 65, 66 67 and 68 and furthermore the (control) connections 61, 62 and 63 may be discrete lines or furthermore by way of a bus.

In the following a check cycle by way of example will be described with reference to FIGS. 2 and 3 for examining the correct function of the arrangement of FIG. 1. The FIGS. 2 and 3 respectively show a table, in whose left hand column headed "ST" the checking and working steps are entered.

The columns headed "31", "32" and "33" contain the neutral position 31, the second position 32 and the first position 33 of the routing valve 30 for the operation of the fluid power cylinder at 10. In this respect "0" in the columns "31", "32" and "33" indicates that the routing valve 30 has not assumed the respective position. Furthermore "0→1" in the column "32" means that the drive 39 is activated and the routing valve 30 has the second position 32 and has reached it at "1". In the column "33" "0→1" means that the drive 40 is activated and the routing valve 30 has assumed the first position 33 and has reached it a "1". In the column "31" the values entered indicate whether the routing valve 30 has assumed the neutral position 31—owing to spring force and the non-activation of the drives 39 or 40—("0→1") ("1), is leaving it ("1→0") or has already left it ("0").

The columns "20", "21" and "23" are to be read in a manner similar to the columns "32" and "33". In the column "23" "0" means that the drive 26 is not activated by the control means 50 and hence the routing valve 23 is in the venting position (=neutral position). The routing valves 20 and 21, whose control by the compressed air on the line 22 is indicated in the columns "20" and "21", are here in the neutral position, that is to say in the turned off position ("0"). If the drive 26 is activated by the control means 50 ("0→1") the routing valve 23 will pass into the switching position ("1").

This means that the routing valves 20 and 21 are also operated and move over into the on position.

The columns "27", "41" and "42" indicate the signals sent by the pressure sensors 27, 41 and 42 to the control means 50, "0" meaning "no pressure present" and "1" meaning control pressure applied". In the case of digitally operating pressure sensors here an "X" stands for an irregular or non-defined intermediate value of the acting pressure. The digital or binary manner of signalizing ("0" or "1") is however only by way of example, for the pressure sensors 27, 41 and 42 can, given a suitable design thereof, also signalize exact intermediate or analog values for the respective acting pressure thereat.

The columns "16" and "17" indicate the messages from the sensor 16 and 17. In this case "0" means that the piston 11 is clear of the respective sensor and the respective sensor is sending a digital signal "0" to the control means 50, whereas the piston 11 at "1" is at a minimum distance from the respective sensor.

FIG. 2 shows a check cycle starting with a step 200 with the piston 11 fully in the first position. The sensor 17 then provides the signal "1" and the sensor 16 provides the signal "0". Furthermore the routing valve 23 and, independently thereof, the routing valves 20 and 21 are activated and the pressure sensor 27 produces the signal "1" so that by way of the routing valve 30 in the active (="1") first position 33 compressed air may flow by way of the lines 37 and 14 into the fluid power cylinder 10. The pressure sensor 41 consequently produces the signal "1", whereas the pressure sensor, which is now connected with the vented line 38, produces the signal "0".

In a step 201 firstly the fluid power cylinder 10 is cut off from the lines 37 and 38 leading to the routing valve 30 and accordingly is cut off from an undesired action of pressure and venting. The control means 50 in this case drives the routing valve 23 to assume the venting position so that the line 22 is vented, the pressure sensor 27 signalizes a pressure dropping to "0" ("0→1") and the routing valves 20 and 21 go into the shut off position ("0→1"). In the transition phase until the routing valve 23 assumes its venting position the pressure sensors 41 and 42 provide a non-defined signal "X".

In a step 202 the routing valves 20 and 21 and moreover the pressure sensors 41 and 42 are then checked. Since the routing valves 20 and 21 are in the closed position the routing valve 30 may be operated without any effect on the fluid power cylinder 10. For this purpose the control means 50 activates the drive 39 and deactivates the drive 40 so that the routing valve switches over from the first position 33 into the second position 32; the pressure sensor 42 sends a signal changing from "0" to "1" owing to the compressed air flowing into the line 38 and the pressure sensor 41 sends a signal changing from "1" to "0" owing to venting of the line 37. If this is not the case there is an error, which is recognized by the control means 50 and for example will be signalized to the higher order control means 57.

In a step 203 the routing valve 30 is shifted into the neutral position 31, because the control means 50 also deactivates the drive 39 as well. The lines 37 and 38 and therefore the chambers of the fluid power cylinder 10 are then cut off both by the routing valves 20 and 21 and also by the routing valve 30 from a pressure action or a venting action.

Accordingly even without any further action on the fluid power cylinder 10 the routing valve 23 and, independently from it, the routing valves 20 and 21 may be activated in a step 204. The respective setting signals of the routing valves 20 and 21 change, like the value detected by the pressure sensor 27, from "0" to "1". Should this not be the case, this will mean an error in the switching off means, which is recognized by the control means 50. It is also possible to arrange sensors in the routing valves 23, 20 and 21, such sensors being connected respectively with the control means 50 whose signals are checked by the control means 50 in the step 203. When then an error occurs, the control means 50 can conclude that there is a security relevant situation or risk and take a counter measure, as for instance it can prevent further actuation of the routing valve 30. If in the step 204 the routing valve 20 shifts into the open position, any compressed air still present in the fluid power cylinder 10 at the end plate end and in the line 14 can flow into the line 37 so that the pressure sensor 41 signalizes values changing from "0" to "1", which are monitored by the control means 50 and if such values are not present the control means 50 will detect a security relevant state.

When the step 204 has been performed without any fault, the control means 50 will, in a step 205, drive the routing valve 30 back into the first position 33, this being done by activation of the drive 40, that is to say by sending a setting signal changing from "0" to "1". This means that the line 15 is vented by way of the line 38 and the venting output 36 and in the case of error-free operation the pressure sensor 42 will signalize values changing from "1" to "0".

The check cycle with the fluid power cylinder 10 in the first position is now terminated. Such a check cycle may be repeated at any time, even when there is no movement of the fluid power cylinder 10, for instance at fixed times and for example after the fluid power cylinder 10 shifts into the first (retracted) position or before the fluid power cylinder 10 shifts into the second position. Such a movement into the second position is represented in a step 206. In this case the control means 50 activates the drive 39 by the transmission of a setting signal changing from "0" to "1". Simultaneously the control means 50 deactivates the drive 40 so that the line 14 is vented by way of the line 37 and the venting output 35 and the pressure sensor 41 signalizes, in the case of a fault-free operation, a value changing from "1" to "0", while the lines 38 and 15 receive compressed air, the pressure sensor 42 signalizes values changing from "0" to "1" and the piston 11 in the fluid power cylinder 10 is shifted into the first position. When the piston 11 reaches the end plate end the sensor 16 will produce a "1" signal and the sensor 17 a "0" signal.

The end of the movement into the second position is then at the same time the starting position illustrated in FIG. 3, denoting a step 300. In the second position as well a check cycle may be performed, as will be described in the following.

In a step 301 with an effect equivalent to that of the step 201 firstly the fluid power cylinder 10 is cut off from the lines 37 and 38 leading to the routing valve 30 and accordingly from any undesired action of pressure and undesired venting.

In a step 302 corresponding to the step 202 the routing valves 20 and 21 and furthermore the pressure sensors 41 42 are checked. The routing valves 20 and 21 are in the off position and the routing valve 30 can consequently be switched over from the second position 32 into the first position 33 by the control means 50 without affecting the fluid power cylinder 10. For this purpose the control means 50 activates the drive 40 and deactivates the drive 39 so that owing to the compressed air flowing into the line 37 the pressure sensor 41 provides a signal changing from "1" to "0" and the pressure sensor 42, owing to venting of the line 38, provides a signal changing from "1" to "0". Should this not be the case, there is a security relevant fault, which is recognized by the control means 50 and same will, for example, activate a warning LED in the display and command input module 59.

In a step 303 the control means 50 will also deactivate the drive 40 so that the routing valve 30 will go into the neutral position and can be neither vented nor supplied with compressed air externally. Then in a step 204 the routing valve 23, and independently thereof, the routing valves 20 and 21 may be activated again and moved into the open position so that compressed air still present in the fluid power cylinder 10 at the end plate end and in the line 15 may flow into the line 38 and the pressure sensor 42 will signalize values changing from "0" to "1". Such values are monitored by the control means 50 as values to be expected so that the control means 50 will signalize a security relevant error if there is a trouble condition.

In a step 305 the control means 50 activates the drive 39 again the so that the routing valve 30 returns to the second position and compressed air present in the lines may escape. The pressure sensor 41 then signalizes values changing from "1" to "0". This check cycle, which is now terminated, can also be repeated at any time.

A step 306 shows how the piston 11 may return to the first position. Here the drive 39 is deactivated and the drive 40 is activated. The pressure sensor 42 signalizes falling pressure values owing to venting and owing to the action of compressed air the pressure sensor 41 signalizes increasing pressure values. After the piston 11 has reached the end plate, the sensor 17 generates the "1" signal and the sensor 41 generates the signal "0".

The control means 50 can implement the check steps represented in FIG. 2 and FIG. 3 in accordance with predetermined criteria, for example criteria set by configuration data. It is also possible for the control means 50 to be provided with a command for the performance of the check steps at the display and command module 59 or by the higher order control means 57. Moreover, the control means 50 may receive from this source a security relevant command, in which the control means 50 is instructed to terminate a security relevant situation, for example, by its putting the routing valves 20 and 21 in the turned off state.

Figure 4:
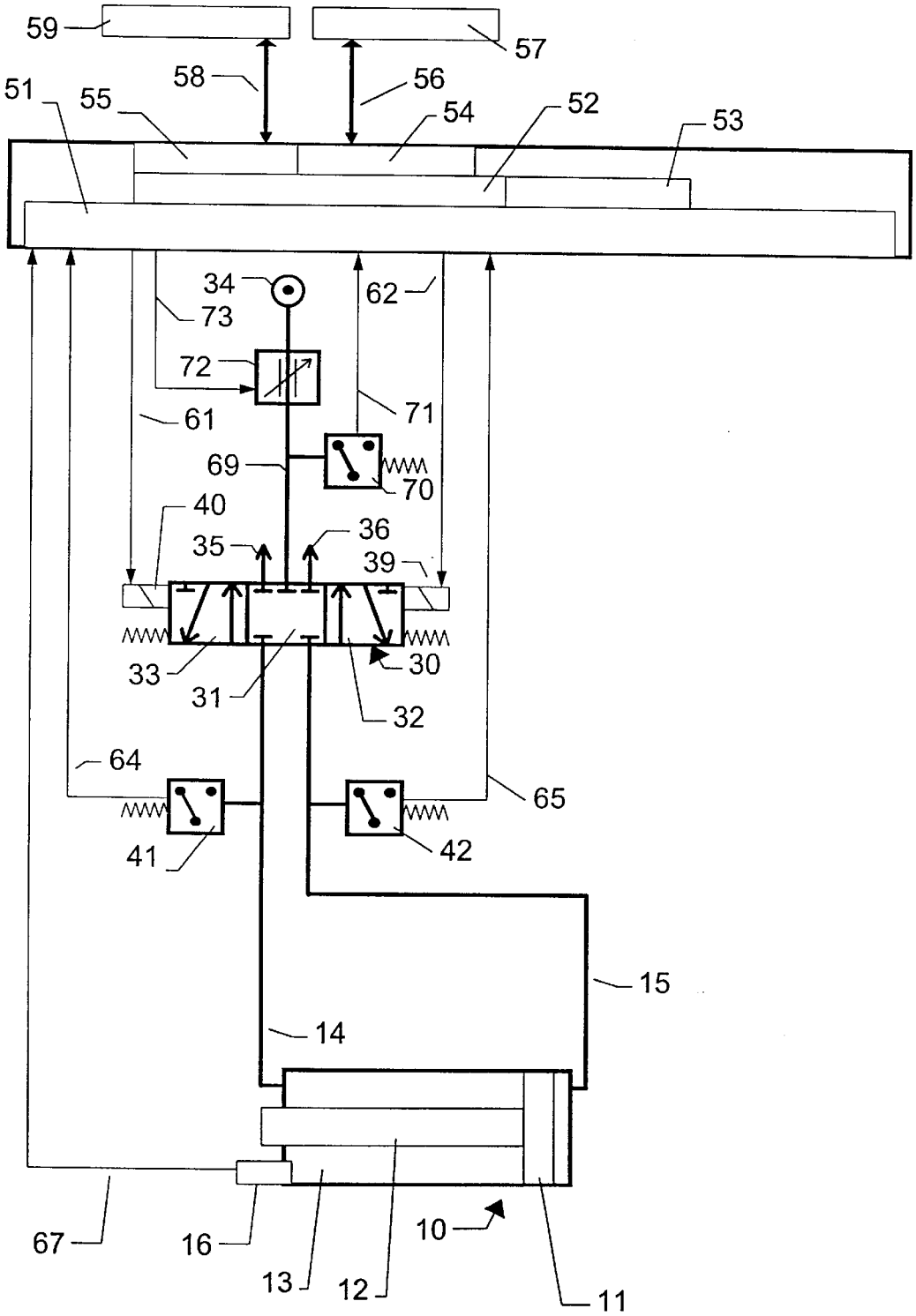
FIG. 4 shows a second working example of the invention with less or modified components than in FIG. 1.

FIG. 4 essentially shows the arrangement of FIG. 1, identical or functionally equivalent components having the same reference numerals. However, the components utilized as switching off means, and more especially the routing valves 20, 21 and 23 and lines and furthermore the pressure sensor 27 employed as switching off check means, are omitted. Furthermore the sensor 17 is omitted, whereas the sensor 16 is in this case designed in the form of a distance apart sensor, which measures the distance of the piston 11 from the end plate of the fluid power cylinder 10. Moreover, a pressure sensor 70 is shown, which is responsive to the compressed air pressure supplied by the pressure source 34 and passing by way of the line 69 to the routing valve 30, it signalizing such pressure by way of a connection 71 to the control means 50. The control means 50 can set the pressure supplied by way of the pressure source 34 to the line 69 using a choke valve 72, which is connected by way of a control connection 73 with the input/output module 51. The choke valve 72 is accordingly a part of the control means.

By control of the routing valve 30 the control means 50 sets, as already explained, the direction of motion of the piston 11, and using the choke valve 72 it sets its holding forces and its speed of movement. The speed of movement can be found by the control means 50 on the basis of the distance, which is found by the sensor 16, and changes with a movement of the piston 11, of the piston 11 from the end plate.

If the speed of movement of the piston 11 is too great, the control means 50, acting by way of choke valve 72, will reduce the pressure on the line 69 and if the, speed of movement is too low, it will increase the pressure. However it is possible for a defect to occur in the choke valve so that for example compressed air would act without reduction in its high pressure on the piston 11 and a piston crash might result from the high speed of motion. The control means 50 will however recognize such a security relevant situation with the aid of the sensor 16 and therefore in an "emergency off function" will move the routing valve 30 into the neutral position 31 so that working space 13 is cut off from the pressure source 34 and at the same time venting is prevented and therefore the piston 11 is braked.

Even if a security relevant fault occurs at the routing valve 30 the control means 50 can recognize same and cause consequential action to be taken as a remedy. If namely the routing valve 30 is for example in the second position 32 equal pressure values must be detected by the pressure sensor 42 and the pressure sensor 70, which are substantially higher than the values detected by the pressure sensor 41 as a consequence of the venting of the line 14. If this is not the case, the control means 50 will recognize this problem and will signalize the problem in a security relevant communication to the higher order control means 57. The latter will then for example instruct the control means 50 to completely close the choke value 72 in a security relevant emergency command.

It is also possible for the control means 50 to drive a lower order control means, not illustrated, in the manner indicated and in a security relevant fashion and for example to lock the fluid power cylinder 10 in an "emergency off function" in response to a warning signal provided by same.

What is claimed is:

1. A fluid control system for the security orientated control of at least one fluid power actuator, comprising at least one local control means for the control of the fluid power actuator by way of control instrumentality means of the fluid control system, at least one sensor being provided for the transfer of at least one information item in relation to at least one operational state of the fluid power system to the local control means, characterized in that the local control means is so designed that it can evaluate at least one item of information for detecting at least one security relevant state and that, given at least one security relevant state, it implements at least one predetermined consequential action wherein the local control means drives the fluid power actuator to assume a safe operational state.

2. The fluid control system as set forth in claim 1, characterized in that it comprises connection means with a higher order control means for the transmission of an information item concerning the presence of the security relevant state using the local control means as a consequential action.

3. The fluid control system as set forth in claim 1, characterized in that it comprises switching off means, able to be driven by the local control means, for switching off the active function of the control means acting on the at least one fluid control actuator.

4. The fluid control system as set forth in claim 3, characterized in that it comprises switching off check means, cooperating with the local control means, for checking the switching off means.

5. The fluid control system as set forth in claim 4, characterized in that the local control means is so designed that it can operate the control instrumentality means in a predetermined fashion for checking the switching off means.

6. The fluid control system as set forth in claim 4, characterized in that the switching off means are able to be operated by fluid power and/or electrically.

7. The fluid control system as set forth in claim 1, characterized in that it comprises control check means cooperating with the local control means, for checking the control instrumentality means.

8. The fluid control system as set forth claim 7, characterized in that the local control means is so designed that for checking the control instrumentality means it can switch off the active function of the control instrumentality means with the aid of the switching off means at least partially.

9. The fluid control system as set forth in claim 7, characterized in that the local control means is so designed that it can check the control instrumentality means in a manner dependent on a predetermined actuation of the control instrumentality means and more particularly after reaching a terminal position of the at least one fluid control actuator and/or at predetermined points in time.

10. The fluid control system as set forth in claim 7, characterized in that it can check a switching off means in a manner dependent on a predetermined operation of the switching off means or of the control instrumentality means, more particularly after reaching a terminal position of the at least one fluid control actuator and/or at predetermined points in time.

11. The fluid control system as set forth in claim 7, characterized in that the local control means is so designed that by way of the connection means it can receive a check instruction from a higher order control means, in which instruction the local control means is instructed to check the control instrumentality means.

12. The fluid control system as set forth in claim 1, characterized in that the local control means is so designed that it can receive by way of the connection means a security relevant instruction from a higher order control means, in which instruction the local control means is instructed to set the fluid control actuator in a safe operational state.

13. The fluid control system as set forth in claim 1, characterized in that the local control means is so designed that on receiving an instruction for the operation of the control instrumentality means it determines whether a security relevant state exists and that the local control means only acts on the instruction when there is no security relevant state.

14. The fluid control system as set forth in claim 1, characterized in that as a consequential action it operates an optical and/or acoustic signalizing means.

15. A fluid control actuator, characterized in that it includes a fluid control system as set forth in claim 1 for security relevant control, by which the actuator is controlled.

16. A local control means for a fluid control system comprising at least one fluid control actuator, which can be controlled by the local control means by way of control instrumentality means, at least one sensor being provided for transfer of at least one information item concerning at least one operational state of the fluid control system to the local control means, characterized in that the local control means is so designed that it can evaluate the at least one information item for detecting at least one sensor state and that, given at least one such security relevant state, it implements at least one predetermined consequential action wherein the local control means drives the fluid power actuator to assume a safe operational state.

17. A software module for a local control means of a fluid control system comprising at least one fluid control actuator, which can be operated by the local electrical control means by way of control instrumentality means, the software module containing program code, which may be implemented by at least one processor of the local control means, the fluid control system containing at least one sensor for the transmission of at least one information item concerning an operational condition of the fluid control system to the local control means, characterized in that the software module comprises evaluation means which are so designed that the local control means may evaluate the at least one information item for the detection of at least one security relevant state and that the software module comprises reaction means which are so designed that the local control means may implement a predetermined consequential action on there being at least one such security relevant situation, wherein the predetermined consequential action includes the local control means driving the fluid power actuator to assume a safe operational state.

18. A method for a fluid control system comprising at least one fluid control actuator, which may be controlled by control instrumentality means of at least one local control means, at least one sensor being provided for the transfer of at least one information item concerning at least one operational state of the fluid control system to the local control means, characterized by the steps:

transfer by the sensor of the at least one information item to the local control means, determination by the local control means, on the basis of the at least one information item whether a sensor situation exists and given the existence of a security relevant situation, performance by the local control means of at least one predetermined consequential action, wherein the consequential action includes the local control means driving the fluid power actuator to assume a safe operational state.

19. The method as set forth in claim 18, characterized in that the local control means checks the control instrumentality means in a fashion dependent on a predetermined operation of the control instrumentality means and more especially after reaching a terminal position of the at least one fluid control actuator and/or at set points in time.

20. The method as set forth in claim 19, characterized in that the local control means checks the control instrumentality means with the aid of a sequence check steps.

21. A fluid control system for the security orientated control of at least one fluid power actuator, comprising at least one local control means for the control of the fluid power actuator by way of control instrumentality means of the fluid control system, at least one sensor being provided for the transfer of at least one information item in relation to the at least one operational state of the fluid power system to the local control means, wherein the local control means is so designed that it can evaluate at least one item of information for detecting at least one security relevant state and wherein, given at least one security relevant state, it implements at least one predetermined consequential action, said fluid control system further comprising switching off means able to be driven by the local control means for switching off the active function of the control means acting on the at least one fluid control actuator, and further comprising control check means cooperating with the local control means for checking the control instrumentality means, and switching off check means cooperating with the local control means for checking the switching off means, and wherein the local control means is so designed that, for checking the switching off means with the aid of the switching off check means, and/or for checking the control instrumentality means with the aid of the control check means, the local control means at least partially switches off the active function of the control instrumentality means with the aid of the switching off means and after checking the control instrumentality means switches on.

22. A local control means for a fluid control system comprising at least one fluid control actuator, which can be controlled by the local control means by way of control instrumentality means, at least one sensor being provided for transfer of at least one information item concerning at least one operational state of the fluid control system to the local control means, characterized in that the local control means is so designed that it can evaluate the at least one information item for detecting at least one sensor state and that, given at least one such security relevant state, it implements at least one predetermined consequential action, the fluid control system further comprising switching off means able to be driven by the local control means for switching off the active function of the control means acting on the at least one fluid control actuator, and further comprising control check means cooperating with the local control means for checking the control instrumentality means, and switching off check means cooperating with the local control means for checking the switching off means, and wherein the local control means is so designed that, for checking the switching off means with the aid of the switching off check means, and/or for checking the control instrumentality means with the aid of the control check means, the local control means at least partially switches off the active function of the control instrumentality means with the aid of the switching off means and after checking the control instrumentality means switches on.

23. A software module for a local control means of a fluid control system comprising at least one fluid control actuator, which can be operated by the local electrical control means by way of control instrumentality means, the software module containing program code, which may be implemented by at least one processor of the local control means, the fluid control system containing at least one sensor for the transmission of at least one information item concerning an operational condition of the fluid control system to the local control means, characterized in that the software module comprises evaluation means which are so designed that the local control means may evaluate the at least one information item for the detection of at least one security relevant state and that the software module comprises reaction means which are so designed that the local control means may implement a predetermined consequential action on there being at least one such security relevant situation, the fluid control system further comprising switching off means able to be driven by the local control means for switching off the active function of the control means acting on the at least one fluid control actuator, and further comprising control check means cooperating with the local control means for checking the control instrumentality means, and switching off check means cooperating with the local control means for checking the switching off means, and wherein the local control means is so designed that, for checking the switching off means with the aid of the switching off check means, and/or for checking the control instrumentality means with the aid of the control check means, the local control means at least partially switches off the active function of the control instrumentality means with the aid of the switching off means and after checking the control instrumentality means switches on.

24. A method for a fluid control system comprising at least one fluid control actuator, which may be controlled by control instrumentality means of at least one local control means, at least one sensor being provided for the transfer of at least one information item concerning at least one operational state of the fluid control system to the local control means, characterized by the steps:

transfer by the sensor of the at least one information item to the local control means;

determination by the local control means on the basis of the at least one information item whether a sensor situation exists; and given the existence of a security relevant situation, performance by the local control means at least one predetermined consequential action, the fluid control system further comprising switching off means able to be driven by the local control means for switching off the active function of the control means acting on the at least one fluid control actuator, and further comprising control check means cooperating with the local control means for checking the control instrumentality means, and switching off check means cooperating with the local control means for checking the switching off means, and wherein the local control means is so designed that, for checking the switching off means with the aid of the switching off check means, and/or for checking the control instrumentality means with the aid of the control check means, the local control means at least partially switches off the active function of the control instrumentality means with the aid of the switching off means and after checking the control instrumentality means switches on.

* * * * *

UNITED STATES PATENT AND TRADEMARK OFFICE

CERTIFICATE OF CORRECTION

PATENT NO. : 6,769,250 B2
DATED : September 10, 2004
INVENTOR(S) : Fuss et al.

It is certified that error appears in the above-identified patent and that said Letters Patent is hereby corrected as shown below:

Column 1,
Delete lines 62-67.

Column 2,
Line 29, "The local control means may also transmit and receive messages specially adapted for; the transfer of security relevant information and for the issue of security relevant commands." and should read -- The local control means may also transmit and receive messages specially adapted for; the transfer of security relevant information and for the issue of security relevant commands. --
Delete lines 58-59.

Column 4,
Line 37, "The line 14 can be switched off by means of a routing valve 21, compressed air then hot being…" and should read -- The line 14 can be switched off by means of a routing valve 21, compressed air then not being… --

Signed and Sealed this

Sixteenth Day of November, 2004

JON W. DUDAS
*Director of the United States Patent and Trademark Office*